United States Patent [19]

Berfield

[11] Patent Number: 5,004,160

[45] Date of Patent: Apr. 2, 1991

[54] ATTACHMENT SYSTEM FOR LIQUID SPRAY LANCE

[75] Inventor: Robert C. Berfield, Jersey Shore, Pa.

[73] Assignee: Shop-Vac Corporation, Williamsport, Pa.

[21] Appl. No.: 494,751

[22] Filed: Mar. 16, 1990

[51] Int. Cl.[5] ..... B05B 15/06

[52] U.S. Cl. ..... 239/525; 239/588; 285/49

[58] Field of Search ..... 239/332, 525, 530, 588; 417/363; 285/49

[56] References Cited

U.S. PATENT DOCUMENTS

| | | | |
|---|---|---|---|
| 4,009,988 | 3/1977 | Duperow et al. | 285/49 |
| 4,285,534 | 8/1981 | Katayama et al. | 285/49 |
| 4,416,475 | 11/1983 | Stacey | 285/49 |
| 4,795,100 | 1/1989 | Purtell et al. | 239/588 |
| 4,861,238 | 8/1989 | Kamiyama et al. | 417/363 |

FOREIGN PATENT DOCUMENTS

| | | | |
|---|---|---|---|
| 0731166 | 4/1980 | U.S.S.R. | 285/49 |

*Primary Examiner*—Andres Kashnikow
*Assistant Examiner*—Karen B. Merritt
*Attorney, Agent, or Firm*—Ostrolenk, Faber, Gerb & Soffen

[57] ABSTRACT

A liquid spray lance is attached to a pump housing by a relatively stiff sleeve. A pump outlet coupling within the pump housing is insulated from transferring vibration to the lance by a hose that passes through the sleeve and that connects the pump outlet coupling to the inlet coupling of the lance. An intermediate portion of the hose is sufficiently flexible and unrestrained as to absorb the pump housing vibration.

8 Claims, 3 Drawing Sheets

10
12
22
24b
24
20
40
30b
30
30a
56
52
60
50
54
22b
58
22a
65

52
54
22a
22
20
24

ATTACHMENT SYSTEM FOR LIQUID SPRAY LANCE

BACKGROUND OF THE INVENTION

The present invention relates to a system for attaching a lance with an outlet spray nozzle to a rigid body of a hand held liquid spray apparatus and particularly to attaching the lance inlet to a pump outlet in a housing. More particularly, the invention relates to such a system by which the pump outlet coupling within the housing is insulated from mechanically transferring the vibration of the pump and the pump housing to the rigid lance. The invention has particular application to a spray apparatus, known as a pressure washer for spraying a high pressure liquid, whose spray is strong enough to wash dirt off the side of a building or a car body.

Some pressure washers are held in the user's hand. They include a pump housing containing a pump within the housing. The pump outlet is connected to dispense liquid at high pressure through the outlet of a spray lance that is rigidly connected to the pump housing. The rigid pump housing is held by an operator who aims the liquid outlet from the lance where the liquid is to be sprayed. It would be desirable to simply rigidly attach the lance to the pump housing. The pump, its outlet coupling and the housing for the pump typically vibrate during pump operation. Further, the spraying of liquid at high pressure from the lance outlet causes the lance and the whole hand held pressure washer to vibrate. Vibration of the pressure washer could make the user uncomfortable and could make the lance difficult to hold or control.

SUMMARY OF THE INVENTION

It is the primary object of the invention to ease the handling and control of a hand held pressure washer.

An object of the invention is to provide a system for attaching a liquid spraying lance to a hand held housing containing a pump whose operation vibrates the pump housing.

Another object is to mechanically insulate the pump housing from the lance to avoid the transfer of vibration.

A further object of the invention is to provide such a system in which the lance can be easily attached to the pump housing.

The foregoing objects are realized in an attachment system for attaching a liquid spraying lance on a hand held pump housing of a pressure washer. A pump housing contains a rigid body and supports a rapidly operating, high pressure, liquid pump which normally vibrates and in turn causes the housing in which the pump is disposed to vibrate. The housing includes the pump outlet which is at a fluid coupling which is fixed on and vibrates with the pump housing. The lance includes a stiff body that transmits liquid from an inlet to the lance to an outlet from the lance.

The attachment system is disposed between the inlet end of the lance and an outlet section of the pump housing. The system includes a rigid sleeve that is to be coupled to the pump housing. A flexible hose extends through that rigid sleeve. The hose has an inlet that is separably coupled to the pump outlet coupling inside the pump housing. The hose has an outlet that is separably attached to a lance inlet coupling. The rigid sleeve surrounds at least an intermediate portion of the length of the hose. The sleeve itself has an inlet end portion respectively anchored inside the pump housing and an outlet portion attached rigidly to the inlet end of the body of the lance. The hose is sufficiently flexible and unrestrained in the sleeve as to absorb the vibration of the pump housing and particularly of the pump outlet coupling and not transmit it to the lance inlet, which substantially insulates the pump housing and the lance from vibration transfer.

Other objects, features and advantages of the present invention will be understood from the following detailed description of an embodiment thereof, with reference to the accompanying drawings.

DETAILED DESCRIPTION OF THE PREFERRED EMBODIMENTS

Figure 1:
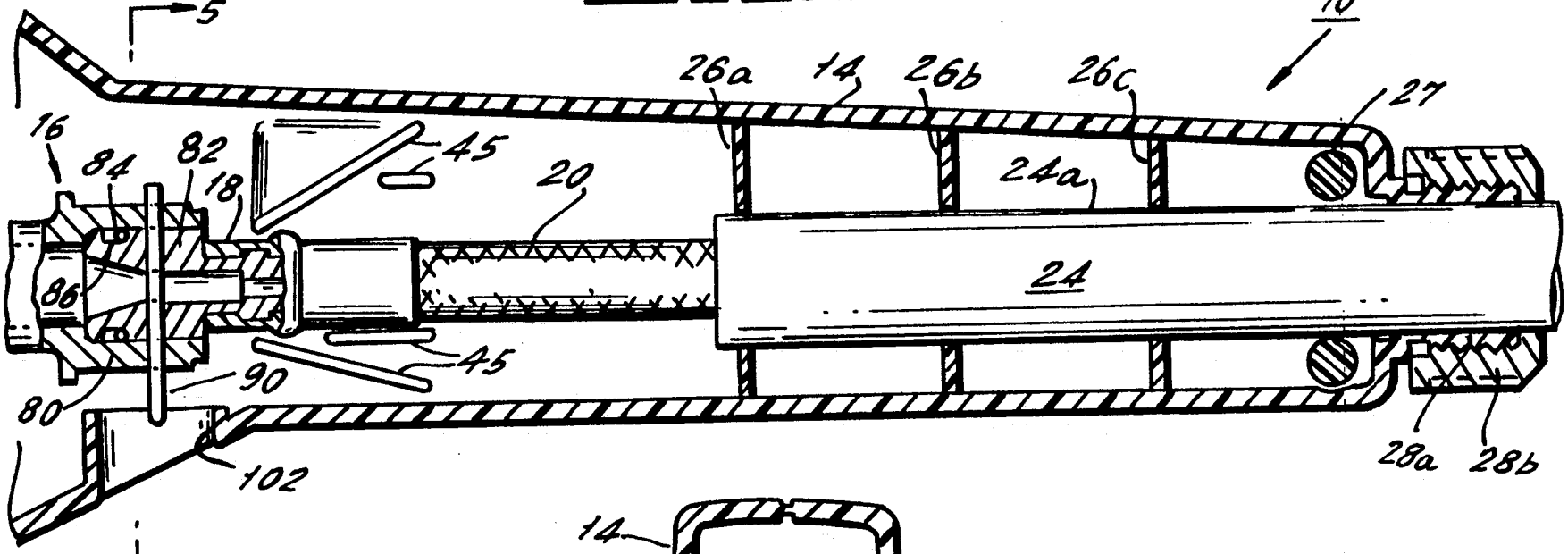
FIGS. 1 and 2 comprise a composite view of an attachment system for a liquid spray lance, and respectively comprise left-hand and right-hand portions of the composite view.
Figure 2:
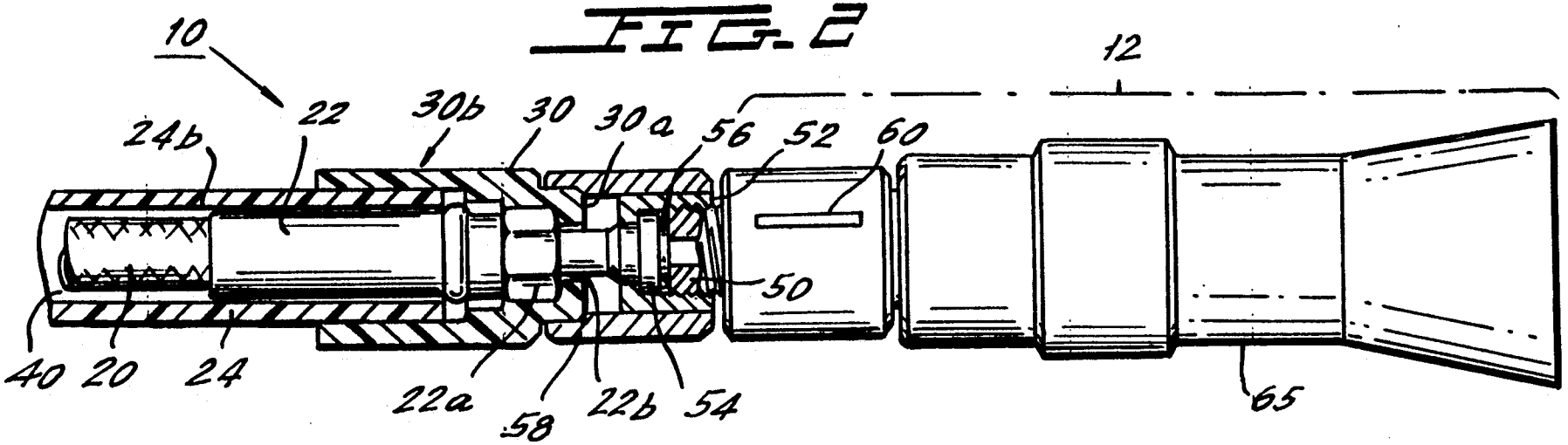

FIGS. 1 and 2 together show an attachment system 10 for a liquid spray lance 12 (FIG. 2). The system 10 includes a rigid plastic or metal housing 14 which is integral with and extends forward from a pump housing 15. Toward the left or inlet end of the housing part 14, there is an outlet coupling 16 from a pump 17 (FIG. 6), which may be of the type shown in U.S. application Ser. No. 07/297,620, filed Jan. 17, 1989, for example. The coupling 16 is rigidly and nonremovably supported inside of and therefore vibrates with the pump housing 14. The pump 17 normally vibrates as it operates at high speed and this vibrates the housing 14 even if the pump is supported in the housing by a shock-absorbing mounting. The pump outlet coupling 16 is intended to be separably coupled with an inlet coupling 18 at the left inlet end of a flexible hose 20.

Figure 3:
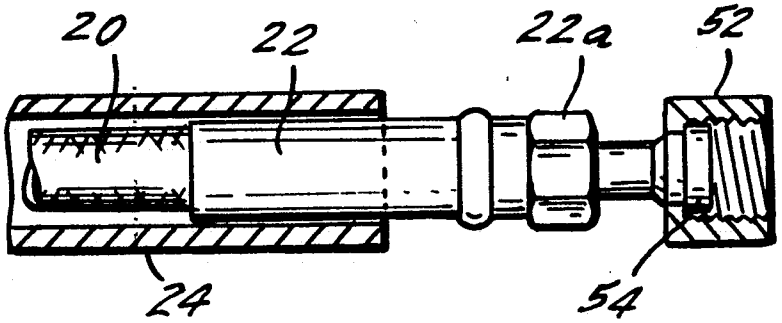
FIG. 3 is a detail view of portions of the hose coupling of FIG. 2.

Referring to FIG. 2, the illustrated outlet end of the hose 20 terminates in a coupling 22, which is shown in FIG. 3. Coupling 22 is connected to the lance 12, which includes an outlet nozzle 65 for spraying a pattern of liquid supplied through the hose 20. The outlet nozzle may be of the type disclosed in copending application Ser. No. 443,922, filed on Nov. 30, 1989, which is incorporated herein by reference.

Surrounding an intermediate portion of the flexible hose 20 is a relatively rigid sleeve 24, made of ABS or PVC plastic, for example. In FIG. 1, the left or inlet end portion 24*a* of the sleeve 24 is anchored inside the housing 14 by internal housing panels 26*a*, 26*b* and 26*c* which are each slotted to snugly surround respective areas of the sleeve 24. The gasket 27 closes the entrance end of the housing 14 and also supports the sleeve portion 24*a*. A bolt extension 28*a* is molded integrally with the housing 14 and extends to the right or outlet end of the pump housing 14. The bolt surrounds and is coaxial with the sleeve 24. A hexogonal profile nut 28*b* 6 is threaded onto the bolt 28*a* during assembly to additionally anchor the left sleeve portion 24*a*.

Preferably, the pump outlet coupling 16 supplies liquid at high pressure to the lance 12 via the hose end couplings 18 at the left and 22 at the right. To accommodate such high pressure, the couplings 16, 18 and 22 should be rated, for example, to handle 2400 p.s.i. of water pressure.

In FIG. 2, the right or outlet end portion 24b of the rigid sleeve 24 is anchored to the hose outlet coupling 22 with the aid of a surrounding sleeve 30 of rigid plastic. The sleeve 30 has a portion 30b, which surrounds the right outlet end of the sleeve portion 24b and is adhered to it, preferably by welding of plastic material. The sleeve 30 extends axially out to snugly and matingly surround a hexagonally faceted nut portion 22a of the coupling 22. Past nut portion 22a the sleeve 30 extends radially inwardly at its portion 30a toward a reduced diameter portion 22b of the coupling 22 located to the right of the faceted portion 22a.

In order to substantially mechanically insulate the housing outlet coupling 16 (FIG. 1) from transferring vibration to the lance 12 (FIG. 2), the hose 20 is sufficiently flexible and is sufficiently unrestrained, that is, it is free of restraint from the surrounding sleeve 24, so that vibration of the coupling 16 is dissipated in the flexible hose 20. The flexible hose 20 is unrestrained in that the portion of the hose 20 to the left of the left portion 24a of the sleeve 24 is unsheathed, and a clearance 40 is provided between the outer diameter of the hose 20 and the inner diameter of the sheath 24.

Figures 4, 6:
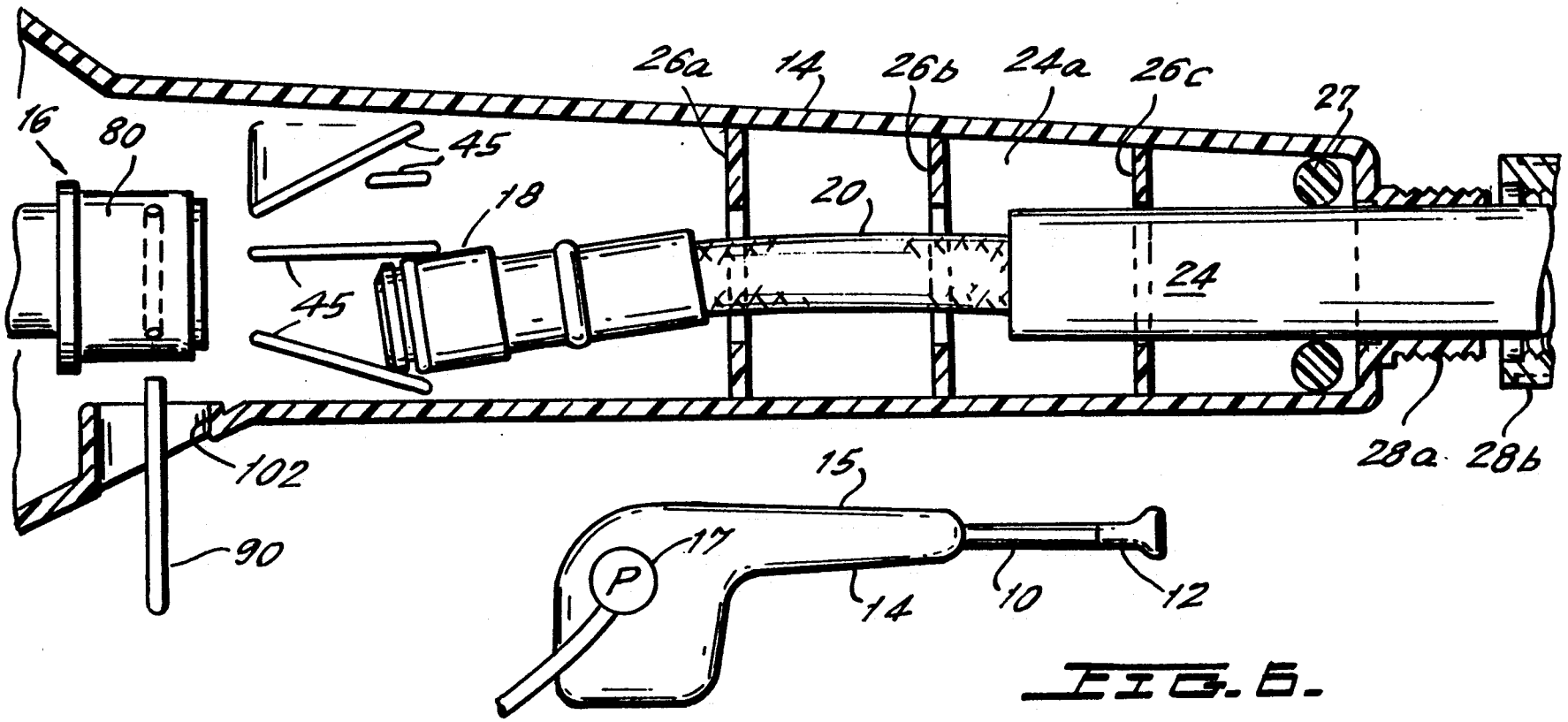
FIG. 4 shows the structure of FIG. 1 during installation of the lance in the housing.
FIG. 6 schematically shows a whole pressure washer including the lance.

Referring to FIGS. 1 and 4, to facilitate assembly of the lance 12 to the housing 14, inclined guide flanges 45 are formed inside the housing 14 axially outward of the pump coupling 16, surrounding the hose coupling 18 and converging inwardly toward the left toward pump outlet coupling 16. As shown in FIG. 4, the guide flanges 45 guide the hose inlet coupling 18 into engagement with the housing coupling 16 when the flexible hose 20, only partially sheathed and not there guided by the sleeve 24, is inserted into the housing 14. After insertion, the sleeve 24 is anchored to the housing 14 by the bolt 28a and nut 28b.

FIGS. 2 and 3 illustrate the joining of the hose outlet coupling 22 to an inlet coupling 50 (FIG. 2) of the lance The hose coupling 22 includes an internally threaded, externally profiled, e.g. hexagonal, cup nut 52 at its axially outward end which is tightened over an externally threaded bolt of a male coupling 50 (FIG. 2) of the lance 12. A disk 54 within the nut 52 of the coupling 22 has a central aperture (not shown) for permitting liquid flow. The disk 54 is separated from the left end of the coupling 50 by a washer 56.

A nut clamping sleeve 58 surrounds the nut 52 of the hose coupling 22. The sleeve 58 is internally profiled to match the external profile of the nut 52, and the sleeve is sufficiently large (e.g., over about one inch in diameter) as to enable manual tightening of the nut 52 onto the lance coupling 50 through turning of the sleeve 58. During the procedure for joining the hose coupling 22 to the lance coupling 50, a marker 60 on the lance 12 is brought into alignment with a corresponding marker (not shown) on the sleeve 58. The nozzle 65 of the lance 12 is rotatable with respect to the lance coupling 50, as further described in the above-referenced, copending application, and the aligned markers indicate the selected nozzle spray outlet of the nozzle 65.

Figure 5:
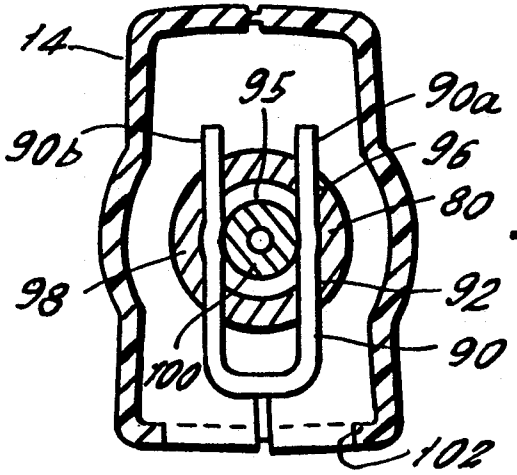
FIG. 5 is a section view taken at arrows 5 in FIG. 1.

Connection of the hose coupling 18 to the housing coupling 16 is now described. In FIGS. 1 and 4, housing coupling 16 includes a cup shaped coupling part 80 with an internal cylindrical space for receiving cylindrical end part 82 of the hose coupling 18. The couplings 16 and 18 are sealed to each other with an O-ring 84 received within a groove 86 in the periphery of the cylindrical coupling part 82. Mechanical securement of the inserted hose coupling 18 to the housing coupling 16 is achieved, for example, by a retaining pin 90. In FIG. 5, the retaining pin 90 has two parallel arms 90a and 90b. Arm 90a passes first through a lower aperture 92 in the housing coupling part 80, then through circumferential groove 95 in the hose coupling part 82, and finally through an upper aperture 96 in the housing coupling part 80. Arms 90a and 90b are symmetrically coupled to the housing and hose couplings 16 and 18. Each of arms 90a and 90b contains a detent (e g. 98) and these are cooperatively pressed toward each other by a resilient self bias of the retaining pin 90, and engage the bottom of groove 95, defined by the outer circumference of hose coupling part 100.

To attach the lance 12 and the sleeve 24 and the unsheathed hose 20 into the housing part 14, a user inserts the hose coupling 18 into the pump coupling 16, with the aid of the guide flanges 45 as described above. Once they are engaged, the user then inserts the retaining 90 pin into the joined couplings 16 and 18 via an access port 102 at the underside of the housing 14. To lock the lance to the housing, the nut 28b on the lance sleeve 24 is tightened onto the bolt 28a on the housing 14, which prevents extraction of the sleeve 24 from the housing 14. Removal of the lance from the housing requires reversing the foregoing steps.

The foregoing describes an attachment system for a liquid handling lance, in which a vibratable coupling contained within a housing is substantially insulated from transferring vibration to the lance. The lance, further, can be easily attached to the associated pump housing.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. An attachment system for a liquid spraying lance, comprising:

a pump housing containing a pump outlet coupling that vibrates along with the housing when a pump operates;

a spray lance attachable to the housing at a location spaced from the pump outlet coupling, the lance having a liquid inlet coupling for flow communication with the pump outlet coupling;

a sleeve having first and second end portions respectively anchored to the housing and to the lance and selectively detachable from each of them;

a hose extending through the sleeve, the hose having an intermediate portion; at opposite ends of the hose, a hose inlet coupling and spaced from it a hose outlet coupling are provided for respective detachable connection to the pump outlet coupling and to the lance inlet coupling;

the sleeve being rigid relative to the intermediate portion of the hose while the intermediate portion of the hose being sufficiently flexible and unrestrained as to substantially insulate the housing and the pump outlet coupling from transferring vibration to the lance inlet coupling.

2. The attachment system of claim 1, wherein the housing includes internal guides for guiding the hose inlet coupling into engagement with the pump outlet coupling.

3. The attachment system of claim 2, further comprising manually operable means at the pump outlet coupling for holding together the hose inlet coupling and the pump outlet coupling.

4. The attachment system of claim 1, wherein the hose outlet coupling and the lance inlet coupling include respective threaded portions that threadedly hold those couplings together.

5. The attachment system of claim 4, wherein one of the threaded portions comprises a threaded nut, and an actuator surrounding the threaded nut and engaging the nut to move the nut as the actuator is rotated to enable manual tightening of the nut.

6. The attachment system of claim 5, wherein the nut is defined on the hose outlet coupling and the actuator comprises an actuator sleeve around the nut, and the sleeve is internally profiled to the profile of the actuator nut.

7. The attachment system of claim 1, comprising anchoring means for anchoring the first end portion of the sleeve to the housing.

8. The attachment system of claim 7, wherein the anchoring means comprises a threaded bolt surrounding and coaxial with the sleeve located at the end of the housing through which the sleeve projects toward the lance and a nut over the bolt locking the bolt to the housing and thereby anchoring the sleeve in the housing.

* * * * *